US010377598B2

(12) United States Patent
Li et al.

(10) Patent No.: US 10,377,598 B2
(45) Date of Patent: Aug. 13, 2019

(54) DYNAMIC PERFORMANCE AND ACTIVE DAMPING METHODS IN WEB WINDER TENSION CONTROL SYSTEMS

(71) Applicants: Eaton Corporation, Cleveland, OH (US); Zhejiang University, Hangzhou (CN)

(72) Inventors: Huaqiang Li, Menomonee Falls, WI (US); Wenxi Yao, Hangzhou (CN); Fayi Chen, Hangzhou (CN); Zhengyu Lu, Hangzhou (CN)

(73) Assignees: Eaton Intelligent Power Limited, Dublin (IE); Zhejiang University, Zhejiang (CN)

( * ) Notice: Subject to any disclaimer, the term of this patent is extended or adjusted under 35 U.S.C. 154(b) by 352 days.

(21) Appl. No.: 15/435,549

(22) Filed: Feb. 17, 2017

(65) Prior Publication Data

US 2018/0237249 A1 Aug. 23, 2018

(51) Int. Cl.
*B65H 23/04* (2006.01)
*B65H 23/06* (2006.01)
(Continued)

(52) U.S. Cl.
CPC ..... *B65H 23/044* (2013.01); *B65H 23/063* (2013.01); *B65H 23/1806* (2013.01);
(Continued)

(58) Field of Classification Search
CPC B65H 23/044; B65H 23/1806; B65H 23/063; B65H 23/195; B65H 2557/264;
(Continued)

(56) References Cited

U.S. PATENT DOCUMENTS 3,829,745 A * 8/1974 Ha ..... B65H 23/1806 361/246
4,151,594 A * 4/1979 Stern ..... B65H 23/063 242/421.1
(Continued)

FOREIGN PATENT DOCUMENTS

JP H07-251216 A 10/1995
JP 2009-240033 A 10/2009
KR 2014-0119851 A 10/2014

OTHER PUBLICATIONS

ABB Application note on Tension Control, AN00212-001, 2012.
(Continued)

*Primary Examiner* — William A. Rivera
(74) *Attorney, Agent, or Firm* — Ziolkowski Patent Solutions Group, SC

(57) ABSTRACT

A control system for controlling operation of main and secondary drive units in a web winder system to provide tension control of a continuous material web is disclosed. The control system causes the main drive unit to operate in a velocity mode to set a linear velocity of the continuous material web. The control system receives inputs from tension and speed detectors in the web winder system that detect a tension and speed of the continuous material web and causes the secondary drive unit to operate in a modified torque regulated closed-loop tension control mode so as to control a tension in the web material, with the control system causing the secondary drive unit to operate according to a torque regulated closed-loop tension control mode and integrate a speed feedback loop into the torque regulated closed-loop tension control mode so as to introduce active damping into the tension control.

20 Claims, 7 Drawing Sheets

(51) Int. Cl.
*B65H 23/10* (2006.01)
*B65H 23/18* (2006.01)
*B65H 23/195* (2006.01)

(52) U.S. Cl.
CPC ..... *B65H 23/195* (2013.01); *B65H 23/105* (2013.01); *B65H 2301/41466* (2013.01); *B65H 2515/32* (2013.01); *B65H 2557/264* (2013.01)

(58) Field of Classification Search
CPC ..... B65H 2515/32; B65H 2301/41466; B65H 23/105
See application file for complete search history.

(56) References Cited

U.S. PATENT DOCUMENTS 4,448,366 A * 5/1984 Fludzinski ..... B65H 23/1806 242/412.2
6,047,275 A 4/2000 Jaremko et al.
6,068,206 A * 5/2000 Lindsay, Jr. ..... B65H 23/1806 242/334.2
6,314,333 B1 * 11/2001 Rajala ..... B65H 23/048 226/44
6,405,098 B1 * 6/2002 Mehlis ..... B65H 23/044 101/225
2004/0044432 A1 * 3/2004 Franz ..... B65H 23/044 700/122
2006/0129266 A1 * 6/2006 Franz ..... B65H 23/044 700/122
2007/0145178 A1 * 6/2007 Fischer ..... B41F 13/03 242/532
2017/0087898 A1 * 3/2017 Iesaki ..... B65H 7/02
2017/0174461 A1 * 6/2017 Kimura ..... B65H 23/192
2017/0267481 A1 * 9/2017 Onodera ..... G05B 19/4189
2018/0273330 A1 * 9/2018 Kakimoto ..... B65H 23/1806

OTHER PUBLICATIONS

Liu, "Dynamic Analysis of Center-Driven Web Winder Controls," Proc. IEEE Ind. Appl. Soc. Annual Meeting IAS, Phoenix, USA, 1999, pp. 1388-1396.
Kong et al., "Active Disturbance Rejection Control Algorithm for the Unwinding Tension System in Gravure Printing Machine," The International Conference on Wavelet Active Media Technology and Information Processing, Chengdu, China, 2012, pp. 86-91.
Liu et al., "Tension Controller Design for Unwinding Tension System Based on Active Disturbance Rejection Control", The IEEE International Conference on Mechatronics and Automation, Chengdu, China, Aug. 5-8, 2012, pp. 1798-1803.
Nevaranta et al., "Indirect Tension Control Method for an Intermittent Web Transport System", 15th International Power Electronics and Motion Control Conference, EPE-PEMC 2012 ECCE Europe, Novi Sad, Serbia, 2012, pp. DS2a2-1-DS2a2-6.
Song et al., "A New Tension Controller for Continuous Strip Processing Line", IEEE Transactions on Industry Applications vol. 36, No. 2, Mar./Apr. 2000, pp. 633-639.

* cited by examiner

DYNAMIC PERFORMANCE AND ACTIVE DAMPING METHODS IN WEB WINDER TENSION CONTROL SYSTEMS

BACKGROUND OF THE INVENTION

The present invention relates generally to controlling tension in a continuous material web and, more particularly, to a system and method for controlling tension in a continuous material web in which the system damping is improved and thus better tension responses are achieved.

The production and processing of strip and sheet materials, i.e., "web handling applications," is actively used in many fields, such as web printing, newspaper pressing, and so on. In such web handling applications, it is a basic requirement that a web of material is produced to a specification which typically includes at least a predetermined thickness and predetermined material properties. To achieve such predetermined requirements, any mechanical forces applied to the web during processing must be accurately controlled. A transfer roll that conveys strip material from one part of a process to another must convey the web material while exerting a controlled tension or pressure that is accurately controlled and evenly distributed over the width of the roll.

In controlling mechanical forces applied to the web, the most important requirement is to make the tension and the linear velocity of the system stable. Thus, quite a few tension control methods have been proposed, such as conventional Proportional-Integral (PI) control, fuzzy self-adaptive Proportional-Integral-Derivative (PID) control, and active disturbance rejection control, for example. Conventional PI control methods are mainly based on torque regulated or speed regulated control. FIGS. 1A and 1B illustrate such torque regulated (1A) and speed regulated (1B) tension controls, respectively. As it can be seen, the toque regulated tension control technique consists of a torque current loop and a tension loop, while the speed regulated tension control technique not only has a torque current loop and a tension control loop, but also has an intermediate speed loop cascaded into the tension loop. From FIG. 1A, the second order open loop transfer function of the torque regulated tension control is obtained according to:

$$G_F(s) = K_{p_F}\left(1 + \frac{K_{i_F}}{s}\right) * K_a * \frac{RK_F}{JF_t s^2 + Js + R^2 K_F} = K_{p_F}\left(1 + \frac{K_{i_F}}{s}\right) * \frac{RK_F K_a}{JF_t \omega_n^2} * \frac{\omega_n^2}{s^2 + 2\xi\omega_n s + \omega_n^2}, \quad \text{[Eqn. 1]}$$

where, in FIG. 1A and [Eqn. 1], F* is the given tension, F is the actual tension, $\omega_m'$ is the actual speed of the main motor, $\omega_m$ is the actual speed of the winder, $G_{PI_F}(z)$ is the PID of the tension loop, $i_{sq}$ is the torque producing current, $K_a$ is the proportionality coefficient between electromagnetic torque and torque current, $K_F$ is the tension constant in kN·s/m, $T_m$ is the motor torque, $G_{\omega_m T}$ is the transfer function between speed and torque, R is the real-time diameter of the winder, $T_L$ is the load torque, $G_{F\Delta v}$ is the dynamic transfer function of tension, $\omega_n$ is the natural frequency, J is the rotational inertia of the winding block, r is the radius of the main motor, and Δv is a velocity difference between a speed near the main motor and a speed near the secondary motor.

From FIG. 1B, the speed regulated tension control is a third order system and is obtained according to:

$$G_F(s) = K_{p_F}\left(1 + \frac{K_{i_F}}{s}\right) * \frac{K_a R K_{p_\omega} K_F (s + K_{i_\omega})}{JF_t s^3 + (J + K_a K_{p_\omega} F_t)s^2 + \left(R^2 K_F + K_a K_{p_\omega} + K_a K_{p_\omega} K_{i_\omega} F_t\right)s + K_a K_{p_\omega} K_{i_\omega}}, \quad \text{[Eqn. 2]}$$

where, in FIG. 1B and [Eqn. 2], F* is the given tension, F is the actual tension, $\omega_m$* is the given speed of the winder, $\omega_m$ is the actual speed of the winder, $G_{PI_F}(z)$ is the PID of the tension loop, $\omega_m'$ is the actual speed of the main motor, $\tilde{\omega}_m(k)$ is the sampling speed of the winder, $G_{PI_\omega}(z)$ is the PID of speed loop, $i_{sq}$ is the torque producing current, $K_a$ is the proportionality coefficient between electromagnetic torque and torque current, $K_F$ is the tension constant in kN·s/m, $T_m$ is the motor torque, $G_{\omega_m T}$ is the transfer function between speed and torque, J is the rotational inertia of the winding block, R is the real-time diameter of the winder, $T_L$ is the load torque, $G_{F\Delta v}$ is the dynamic transfer function of tension, $G_d$ is the delay of speed sampling, r is the radius of the main motor, and Δv is a velocity difference between a speed near the main motor and a speed near the secondary motor.

In order to have a good dynamic performance for tension control, Kp and Ki, of tension PI controller gains should be properly designed to achieve sufficient system gain and phase margins. However, it is recognized that the crossover frequency of torque regulated tension control is smaller than that of speed regulated tension control. The step response of torque regulated tension control tends to vibrate more easily because the crossover frequency of the torque regulated tension control system is limited by low damping of its natural resonant frequency. Although a derivation term can be added in PID control to achieve fast system tension response, it will introduce noise to the system. This small incurred noise may be acceptable in common continuous system; however, it is improper for systems with high control performance requirements, such as discontinuous systems. In the speed regulated tension control, the dynamic performance is improved by introducing the cascaded speed loop. However, the crossover frequency of this kind of tension loop is limited by the relatively low speed loop bandwidth, especially for systems with a large inertia.

It would therefore be desirable to provide a system and method for controlling tension in a continuous material web, with such a system and method providing a fast, dynamic system tension response with low vibration and low noise and useable with a variety of different systems, including systems with a large inertia.

BRIEF DESCRIPTION OF THE INVENTION

In accordance with one aspect of the invention, a control system for controlling operation of a main drive unit and a secondary drive unit in a web winder system to provide tension control of a continuous material web as it is translated between an unwinder and winder of the web winder system is provided. The control system includes a processor programmed to cause the main drive unit to operate in a velocity mode to set a linear velocity of the continuous material web, receive inputs from tension and speed detectors in the web winder system that detect a tension in and a speed of the continuous material web, and cause the secondary drive unit to operate in a modified torque regulated closed-loop tension control mode so as to control a tension in the web material. In operating in the modified torque regulated closed-loop tension control mode, the processor is further programmed to cause the secondary drive unit to operate according to a torque regulated closed-loop tension control mode, based on inputs from the tension detectors and integrate a speed feedback loop into the torque regulated closed-loop tension control mode, via inputs from the speed detectors, so as to introduce active damping into the tension control.

In accordance with another aspect of the invention, a web handling system for controlling tension in a web material includes a winder and unwinder between which a web material is transferred and a main drive unit comprising a first electric motor and first adjustable speed drive, the first electric motor and first adjustable speed drive rotationally driving guide rollers to translate the web material from the unwinder to the winder. The web handling system also includes a secondary drive unit comprising a second electric motor and second adjustable speed drive, the second electric motor and second adjustable speed drive rotationally driving the winder to roll the web material onto the winder. The web handling system further includes tension and speed detectors to detect a tension in and a speed of the web material between the unwinder and the winder and a control device to control operation of the main drive unit and the secondary drive unit to rotationally drive the guide rollers and the winder, respectively, at desired rotational speeds, wherein, in controlling operation of the main drive unit and the secondary drive unit to rotationally drive the guide rollers and the winder at desired rotational speeds, the control device is configured to cause the main drive unit to operate in a velocity mode to set a linear velocity of the web material cause the secondary drive unit to operate in a torque regulated closed-loop tension control mode, via inputs from the tension detectors, so as to control a tension in the web material, and integrate a speed feedback loop into the torque regulated closed-loop tension control mode, via inputs from the speed detectors, so as to introduce active damping into the tension control.

In accordance with yet another aspect of the invention, a method of controlling tension control in a continuous material web translated between an unwinder and a winder in a web winder system includes controlling a main drive unit of the web winder system to operate in a velocity mode to set a linear velocity of the continuous material web and controlling a secondary drive unit of the web winder system to operate in a modified torque regulated closed-loop tension control mode so as to control a tension in the web material, wherein, in controlling the secondary drive unit, the modified torque regulated closed-loop tension control mode comprises a torque current loop, a tension loop, and a speed feedback loop to control the tension in the web material.

Various other features and advantages of the present invention will be made apparent from the following detailed description and the drawings.

BRIEF DESCRIPTION OF THE DRAWINGS

The drawings illustrate preferred embodiments presently contemplated for carrying out the invention.

In the drawings.

DETAILED DESCRIPTION

Embodiments of the invention relate to a system and method for controlling tension in a continuous material web and, more particularly, to a system and method for controlling tension in a continuous material web in which the system damping is improved and thus better tension responses are achieved. Main and secondary drive units in the web winding system are operated in a velocity mode and a modified torque regulated closed-loop tension control mode, respectively, with a speed feedback loop being integrated into the torque regulated closed-loop tension control mode to improve system damping and achieve faster response time in controlling the tension in the continuous material web.

Figure 1A:
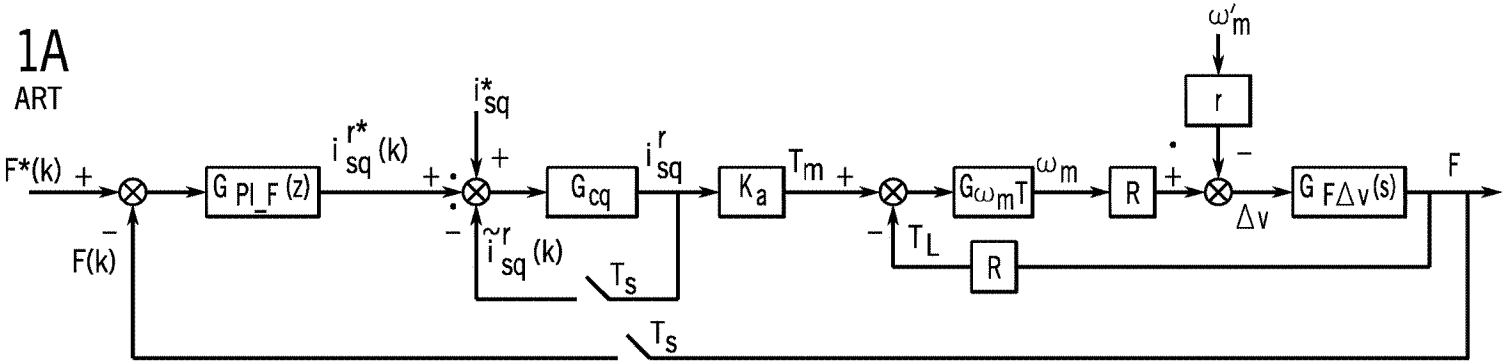
FIG. 1A PRIOR ART
FIG. 1A is a block diagram of a torque regulated tension control scheme for controlling tension in a continuous material web, as known in the prior art.
Figure 1B:
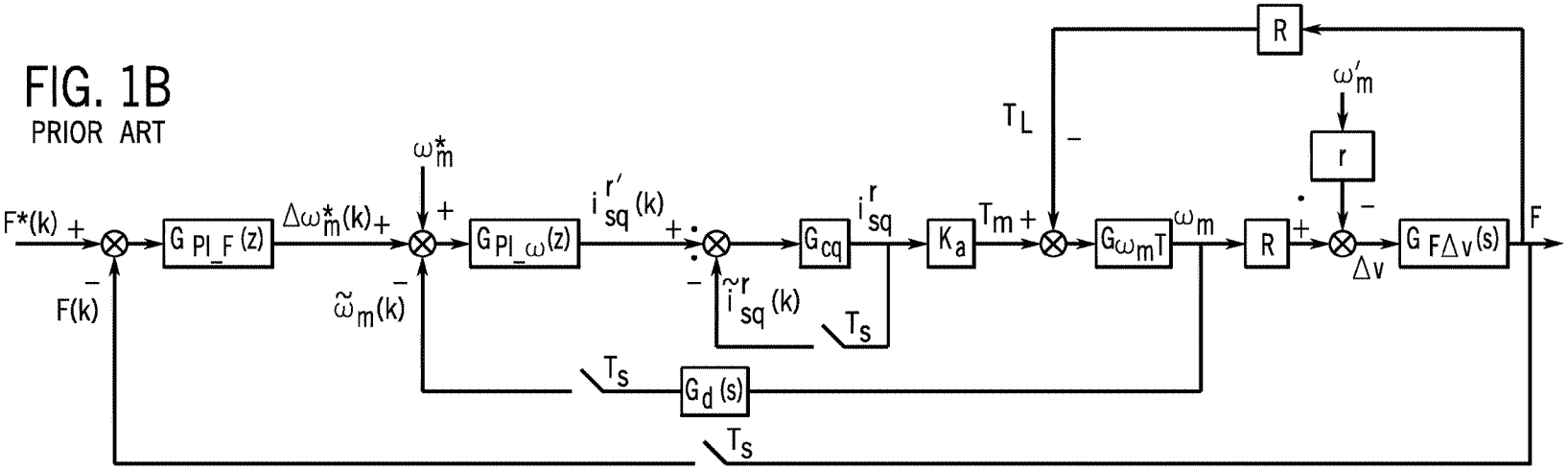
FIG. 1B PRIOR ART
FIG. 1B is a block diagram of a speed regulated tension control scheme for controlling tension in a continuous material web, as known in the prior art
Figure 2:
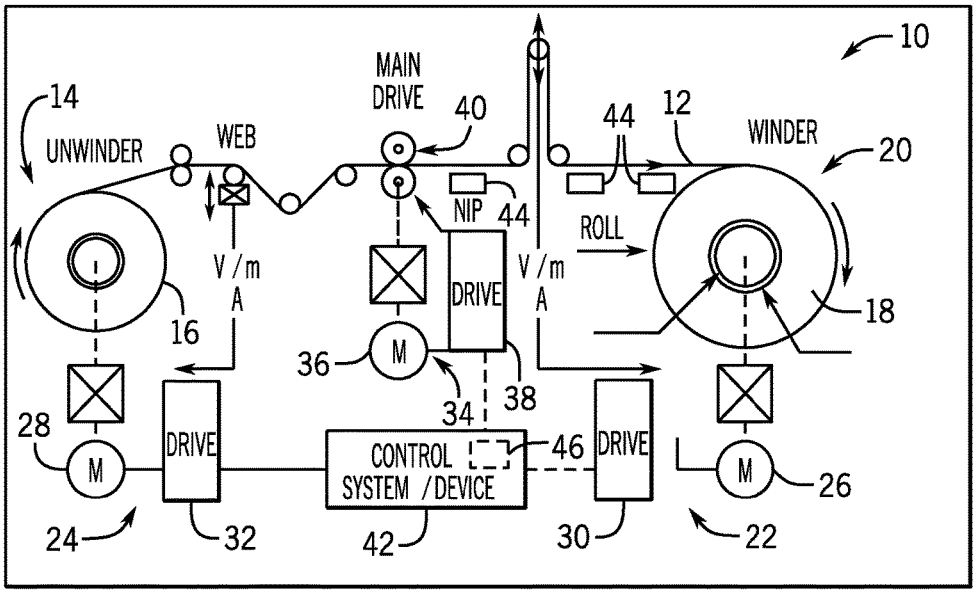
FIG. 2 is a block schematic diagram of a web winder system useable with embodiments of the invention.

FIG. 2 is a diagram showing a system 10 for winding and unwinding a product film or web material, i.e., a "web winder system," with such winding and unwinding being performed in a tightness-controlled manner to ensure integrity of the web material 12. The system of FIG. 2 may be, for example, a post-processing apparatus for paper, such as a calendar/presser, printer, or any other processing apparatus for a continuous material web, wherein the material 12 is unwound from one roll and wound onto one or more other rolls during such post-processing.

FIG. 2 shows an unwinder 14, in which a machine reel or roll 16 of web material 12 is placed, with the web material being unwound from the roll 16 and provided to a machine reel or roll 18 on a winder 20 (i.e., "rewinder") in the system 10. According to the embodiment of FIG. 2, each of the unwinder 14 and winder 20 includes a respective drive unit 22, 24 comprised of an electric motor 26, 28 (e.g., AC induction motor) that is controlled by a motor drive 30, 32, such as an adjustable speed drive (ASD. The motor drives 30, 32 allow for dynamic control of the motors 26, 28 to control movement of the web material 12 between the unwinder 14 and winder 20.

As further shown in FIG. 2, a main drive unit 34 is also included in system 10 that is positioned between unwinder 14 and winder 20. The main drive unit 34 includes an electric motor 36 (e.g., AC induction motor) that is controlled by a motor drive 38, such as an ASD. The main drive unit 34 operates to rotationally drive two nip rolls or rollers 40 that apply a force therebetween to generate a frictional tension along the web material 12 proportional to the force and the coefficient of friction between the material and the nip surface.

FIG. 2 also shows a control system or device 42 that is operably connected to each of the drive units 22, 24, 34 (i.e., to the motor drives 30, 32, 38) and also to speed and tension sensors 44 positioned at various points along web material 12. The control system 42 provides control information to the motor drives 30, 32, 38, which control the respective motors 26, 28, 36 on the basis of the control information to provide a desired web speed and web tightness, for instance. The control system 42 may be provided as a PI controller or PID controller, according to embodiments of the invention, that includes a processor 44 therein for executing commands to implement the desired control.

Figure 3:
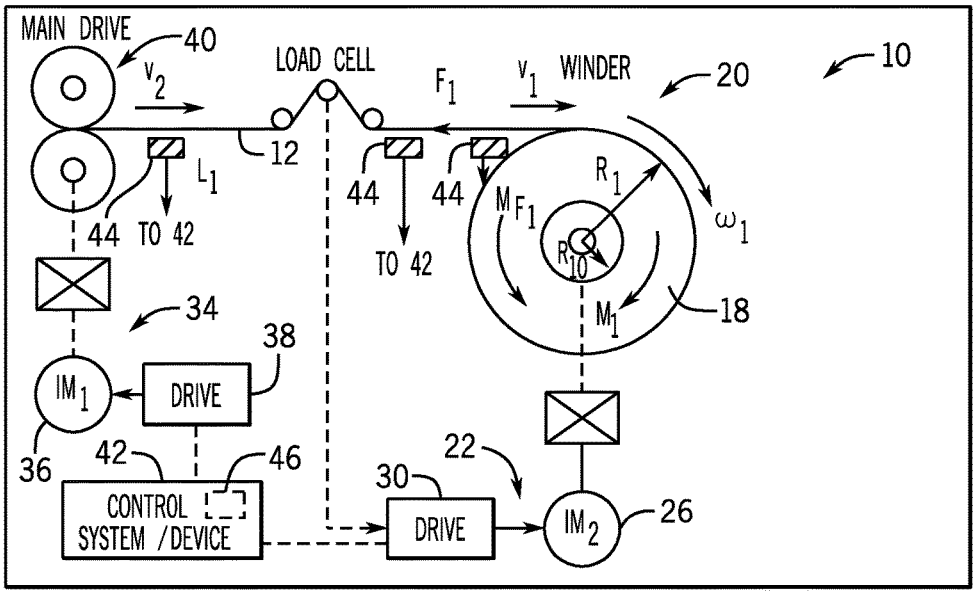
FIG. 3 is a simplified block schematic diagram of the web winder system of FIG. 2.

According to an exemplary embodiment, the control system 42 implements a torque regulated tension control scheme with active damping to control tension in the web material 12. The torque regulated tension control with the added active damping provides for a higher crossover frequency of the PI tension controller loop as compared to previously used torque regulated tension control techniques, so as to provide improved/faster tension responses in the system 10 and thereby further improve the dynamic performance of the system. Following here below, and with reference to a simplified diagram of the web winder system 10 and associated measurable parameters of the system 10 provided in FIG. 3, is a discussion of the control scheme implemented by control system 42 for controlling operation of the main drive unit 34 and the drive unit 22 (i.e., the "secondary drive unit"). In FIG. 3, $K_F$ is the tension constant in kN·s/m, $v_1$ represents the linear velocity at which the primary volume core axis winds the coiled material, $v_2$ represents the linear velocity at which the transport wheel sends out the coiled material, $\omega_1$ represents the real-time angular velocity of the primary volume, $R_{10}$ represents the radius of the primary volume core axis, $R_1$ represents the real-time radius of the winding, $F_1$ represents the tension that applies to the primary volume core axis and the coiled material, J is the rotational inertia of the winding block, $M_1$ is the equivalent drive torque which applies to the winding block, and $M_{F_1}$ is the mechanical friction torque which applies to the wingding block.

In operation of the system 10 and the movement of web material 12 thereby, the control system 42 operates to set the linear velocity of the web process application via controlling of the main drive unit 34 working in a velocity mode, with the main drive unit 34 acting as a master drive in the system 10. The winder 20 and its associated secondary drive unit 22 acts as a slave drive operating in the torque closed-loop tension control mode. Assuming that no viscous term and no slip between the roll 18 and web material 12, the tension model is expressed as:

$$G_{F\Delta v}(s) = \frac{F(s)}{\Delta V(s)} = \frac{K_F}{F_t s + 1}, \qquad \text{[Eqn. 3]}$$

where $K_F/F_t$ is the strip spring constant and $1/F_t$ represents the inverse of the web material-span time constant.

Figure 4:
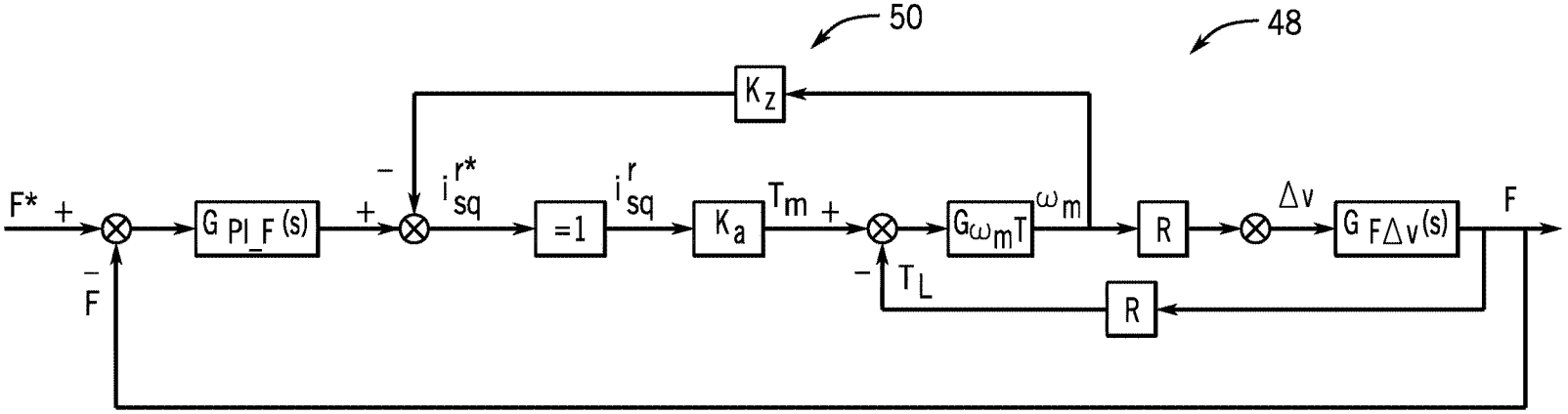
FIG. 4 is a block diagram of a torque regulated tension control scheme with active damping for controlling tension in a continuous material web, according to an embodiment of the invention.

As can be seen in the block diagram of FIG. 4, in implementing the torque regulated tension control scheme with active damping 48 (i.e., the "modified torque regulated closed-loop tension control mode") via control system 42, the numerator includes a first order term of 's', which means that the system damping could be increased by speed feedback, indicated at 50, with the transfer function between torque current and motor speed being expressed as:

$$G_{\omega_m i_{sq}} = \frac{K_a G_{\omega_m T}}{1 + G_{\omega_m T} R^2 G_{F\Delta v}} = \frac{K_a + K_a F_t s}{J F_t s^2 + J s + R^2 K_F}, \qquad \text{[Eqn. 4]}$$

Accordingly, the open loop transfer function therefore becomes:

$$\begin{aligned} G_F(s) &= K_{p_F}\left(1 + \frac{K_{i_F}}{s}\right) = \frac{K_a R K_F}{J F_t s^2 + (K_z K_a F_t + J)s + R^2 K_F + K_z K_a} \\ &= K_{p_F}\left(1 + \frac{K_{i_F}}{s}\right)\frac{R K_F K_a}{J F_t \omega_n^2} * \frac{\omega_n^2}{s^2 + 2\xi\omega_n s + \omega_n^2}, \end{aligned} \qquad \text{[Eqn. 5]}$$

where, in FIG. 4 and [Eqn. 4] and [Eqn. 5], F* is the given tension, F is the actual tension, $\omega_m$ is the actual speed of the winder, $G_{PI_F}(s)$ is the PID of the tension loop, $i_{sq}$ is the torque producing current, $K_a$ is the proportionality coefficient between electromagnetic torque and torque current, $K_F$ is the tension coefficient, $K_{i_F}$ and $K_z$ are tension PI coefficients, $T_m$ is the motor torque, $G_{\omega_m T}$ is the transfer function between speed and torque, R is the real-time diameter of the winder, J is the rotational inertia of the winding block, $T_L$ is the load torque, $G_{F\Delta v}$ is the dynamic transfer function of tension, $\omega_n$ is the natural frequency, $\xi$ is the damping factor, r is the radius of the main motor, and $\Delta v$ is a velocity difference between a speed near the main motor and a speed near the secondary motor.

As can be seen in comparing the open loop transfer function of [Eqn. 5] implemented in the modified torque regulated tension control scheme (i.e., with active damping) to the open loop transfer function of [Eqn. 1] implemented in a prior art torque regulated tension control scheme, the system damping is increased significantly and the dominant pole pair $\{w_p, \xi_p\}$ in the plant of tension control is moved into the location:

$$\left\{\sqrt{\omega_P^2 + \frac{K_a K_z}{J F_t}},\ \frac{1}{2\sqrt{\omega_P^2 + \frac{K_a K_z}{J F_t}}}\left(2\xi\omega_p + \frac{K_z K_a}{J}\right)\right\}. \qquad \text{[Eqn. 6]}$$

Figure 5A:
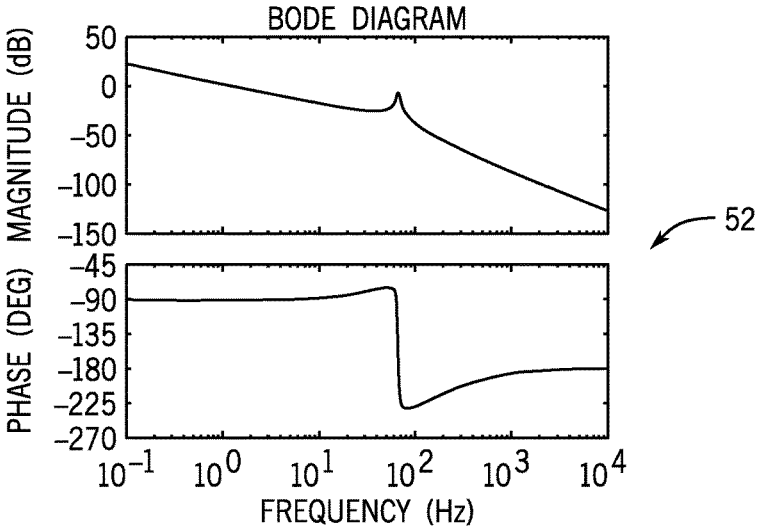
FIG. 5A PRIOR ART
FIGS. 5A-5C are graphs illustrating Bode diagrams for a prior art torque regulated tension control technique, a prior art speed regulated tension control technique, and an exemplary torque regulated tension control technique with active damping, respectively.
Figure 5B:
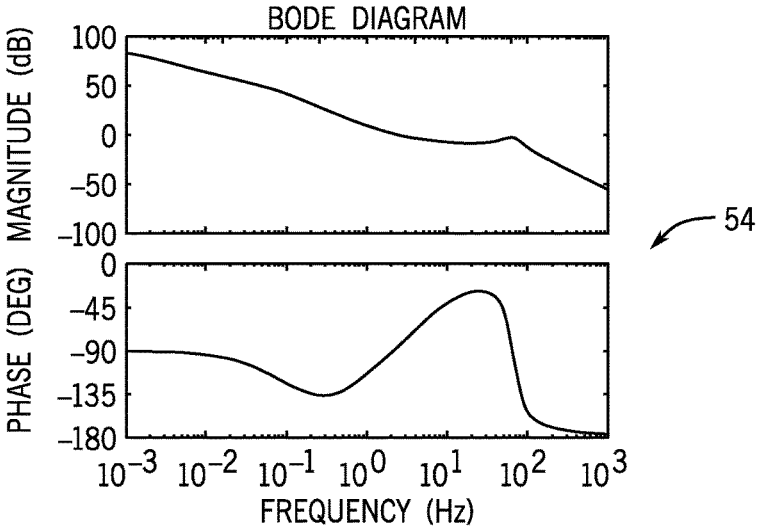
FIG. 5B PRIOR ART
Figure 5C:
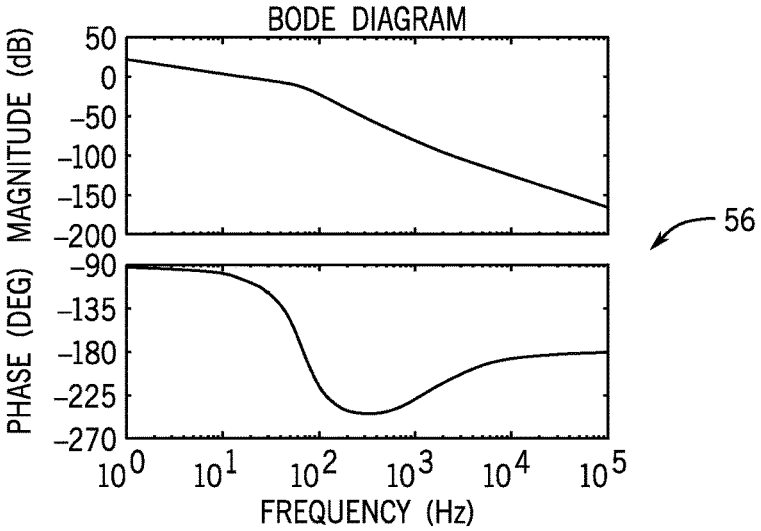

With proper feedback parameter $K_z$ and tuned $K_p$, $K_i$ of tension PI control parameters, a crossover frequency of the proposed tension loop is increased and an improved dynamic performance is achieved as compared prior art torque regulated and speed regulated tension control techniques. FIGS. 5A-5C illustrate Bode diagrams 52, 54, 56 for a prior art torque regulated tension control technique (FIG. 5A), a prior art speed regulated tension control technique (FIG. 5B), and an exemplary torque regulated tension control technique with active damping (FIG. 5C). As can be seen by a comparison of the figures, the crossover frequency of the proposed tension loop defined in FIG. 5C is larger than those provided in FIGS. 5A and 5B, with a much improved dynamic performance being achieved.

Figure 6A:
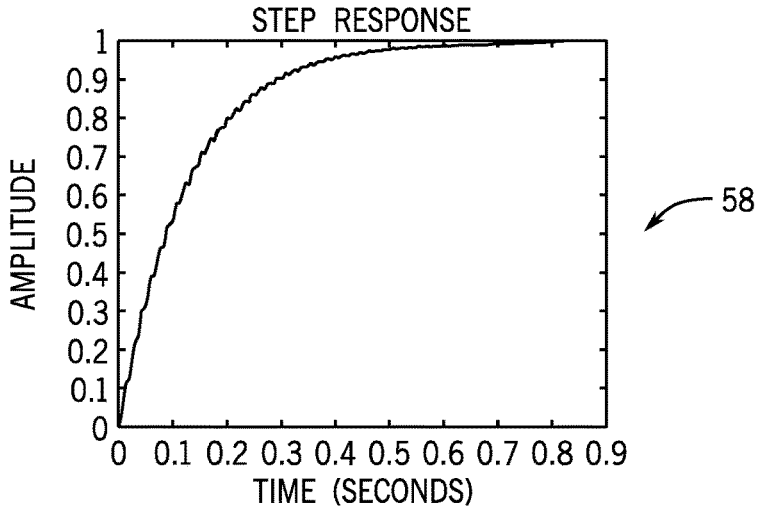
FIG. 6A PRIOR ART
FIGS. 6A-6C are graphs illustrating tension step response diagrams for a prior art torque regulated tension control technique, a prior art speed regulated tension control technique, and an exemplary torque regulated tension control technique with active damping, respectively.
Figure 6B:
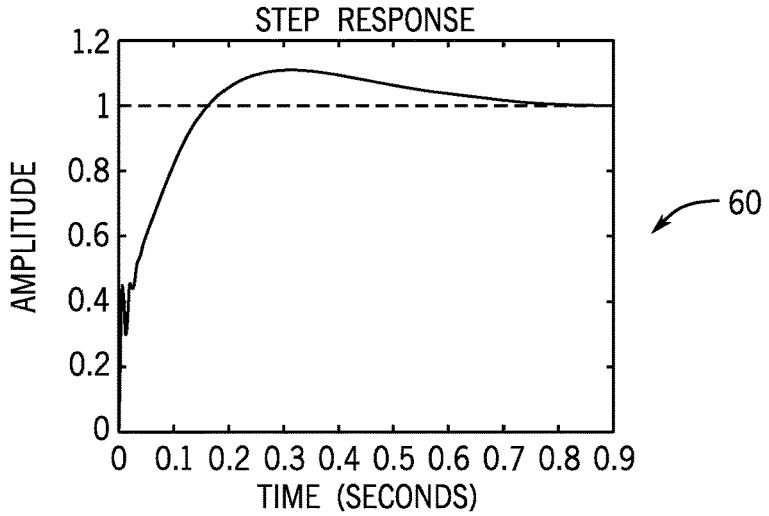
FIG. 6B PRIOR ART
Figure 6C:
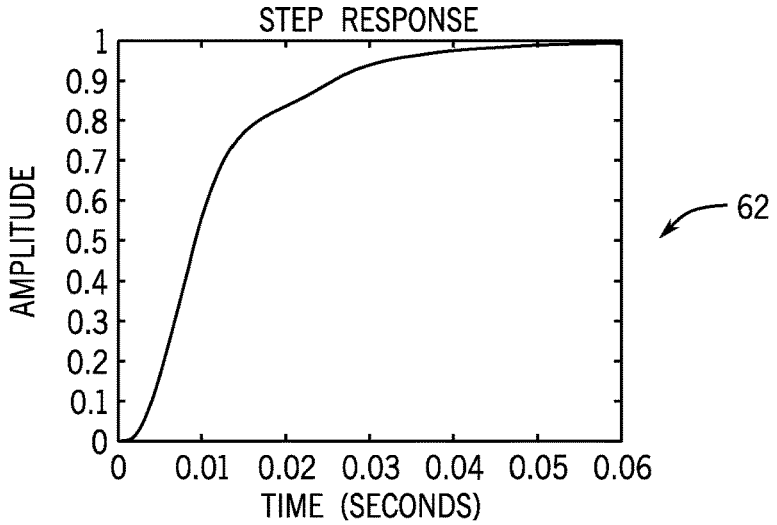

Referring now to FIGS. 6A-6C, tension step response diagrams 58, 60, 62 are illustrated for a prior art torque regulated tension control technique (FIG. 6A), a prior art speed regulated tension control technique (FIG. 6B), and an exemplary torque regulated tension control technique with active damping (FIG. 6C). As can be seen by a comparison of the figures, the step response of the torque regulated tension control (FIG. 6A) tends to vibrate more easily based on the crossover frequency of the torque regulated tension control system being limited by low damping of its natural resonant frequency, with such vibration being eliminated in the tension step response defined in FIG. 6C. As shown in FIG. 6C, the tension system step response time is significantly faster than those in FIG. 6A and FIG. 6B.

Figure 7A:
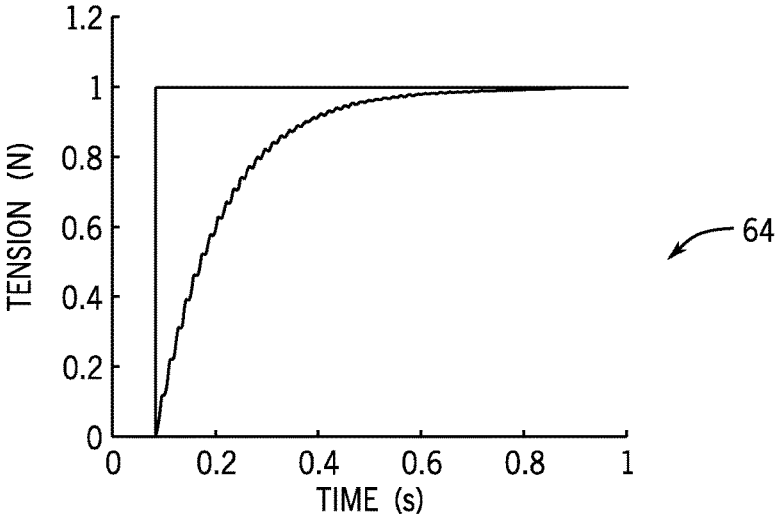
FIG. 7A PRIOR ART
FIGS. 7A-7C are graphs illustrating tension control step responses resulting from an exemplary simulation, for a prior art torque regulated tension control technique, a prior art speed regulated tension control technique, and an exemplary torque regulated tension control technique with active damping, respectively.
Figure 7B:
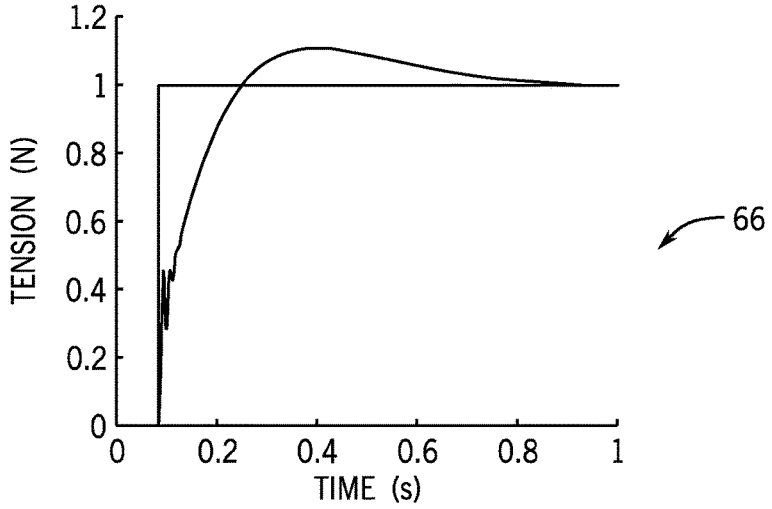
FIG. 7B PRIOR ART
Figure 7C:
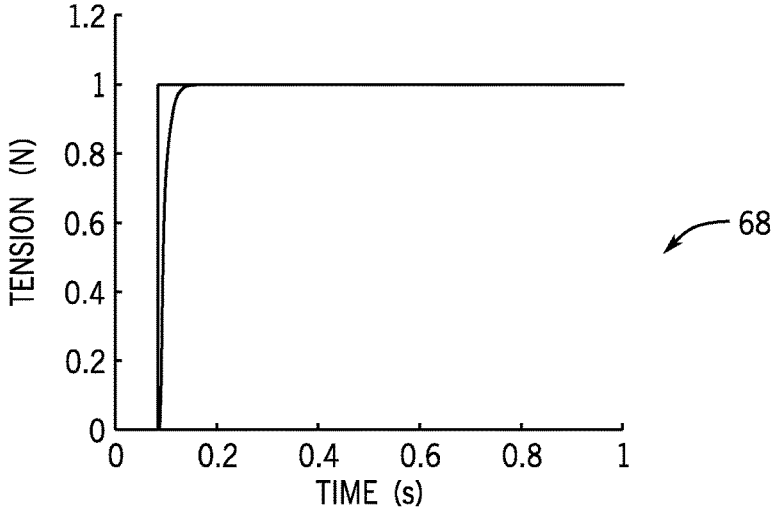

An example of tension control results achieved via implementation of an exemplary torque regulated tension control technique with active damping is set forth here below, according to an exemplary embodiment. In the example, a time-domain simulation platform utilizing Matlab/Simulink evaluates the performance of the proposed tension control method, with the main system parameters including:

Asynchronous machine: 30 kW, 50 Hz, 380V
DC-bus voltage: 540V
Switching frequency: 6 kHz
Sampling frequency: 12 kHz
Initial radius of winder: 0.1 m
Radius of main driver: 0.02 m
Feedback slip without tension (S): 0.08
Roll thickness ($\sigma$): 10 um
Coefficient of forward slip effect ($\beta$): 0.5 kN
Cross-sectional area of winder ($A_0$): 2.27 $mm^2$
Distance between winder and main drive (L): 3500 mm
Elasticity modulus (E): 2.058×105 $N/mm^2$
Linear velocity of processing ($V_b$): 3 m/s In the simulation, the main/master drive unit 34 is in the velocity mode and the secondary/slave drive unit 22 is in closed tension loop, applying different tension control methods—i.e., a prior art torque regulated tension control technique, a prior art speed regulated tension control technique, and an exemplary torque regulated tension control technique with active damping. The corresponding simulation results are depicted in FIGS. 7A-7C, with tension control step responses 64, 66, 68 being illustrated for the prior art torque regulated tension control technique (FIG. 7A), the prior art speed regulated tension control technique (FIG. 7B), and the exemplary torque regulated tension control technique with active damping (FIG. 7C). It can be seen in FIGS. 7A-7C that the proposed torque mode of closed loop tension control with active damping has the best dynamic performance with superior step response time, while not exhibiting any overshoot.

Figure 8A:
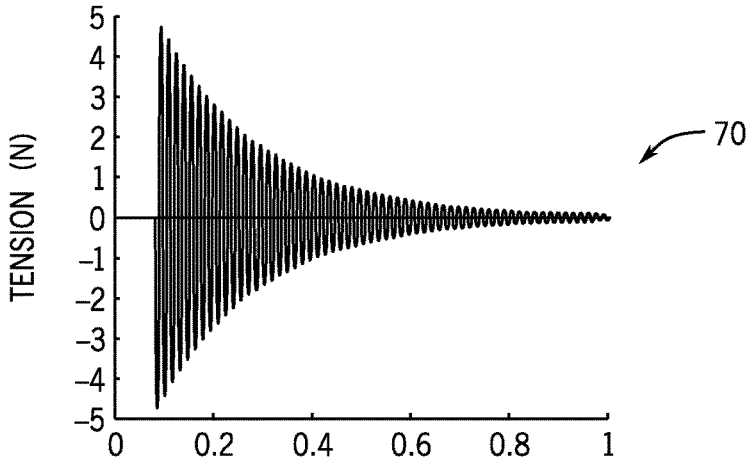
FIG. 8A PRIOR ART
FIGS. 8A-8C are graphs illustrating tension control step responses resulting from an exemplary simulation where velocity disturbance is introduced, for a prior art torque regulated tension control technique, a prior art speed regulated tension control technique, and an exemplary torque regulated tension control technique with active damping, respectively.
Figure 8B:
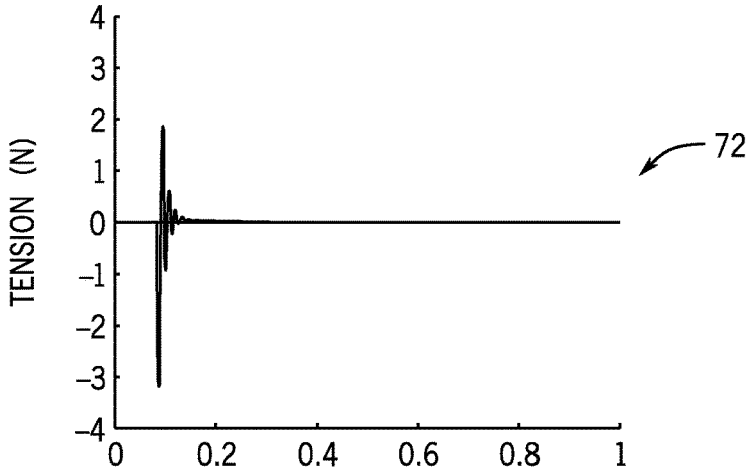
FIG. 8B PRIOR ART
Figure 8C:
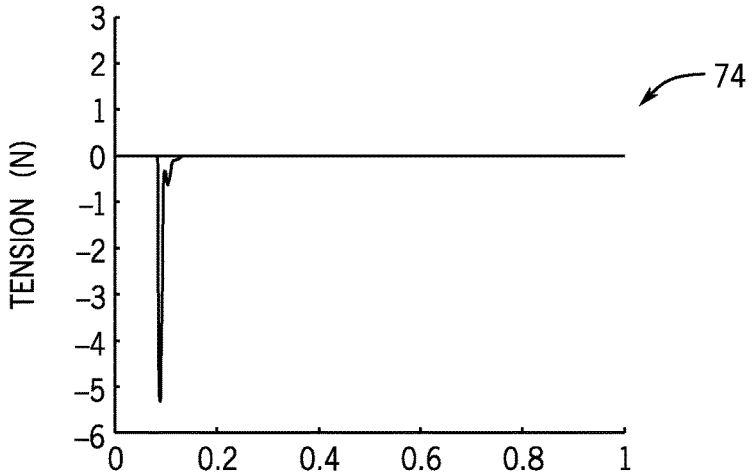

Referring now to FIGS. 8A-8C, the disturbance rejection capability of each of the different tension control methods is evaluated. FIGS. 8A-8C illustrate the performance of the tension loop when a velocity disturbance is introduced, with tension control step responses 70, 72, 74 being illustrated for the prior art torque regulated tension control technique (FIG. 8A), the prior art speed regulated tension control technique (FIG. 8B), and the exemplary torque regulated tension control technique with active damping (FIG. 8C). It can be seen in FIGS. 8A-8C that the proposed torque mode of closed loop tension control with active damping eliminates the tension system oscillation completely when a velocity disturbance is introduced onto the web material.

Beneficially, embodiments of the invention thus provide a torque regulated tension control with active damping that is accomplished by introducing an additional speed feedback loop to a torque regulated tension control. Introduction of the speed feedback loop enables the web winding system to achieve large system natural frequency and damping, thereby increasing system responsiveness in controlling tension in the web material in a dynamic fashion.

A technical contribution of embodiments of the present invention is that a computer implemented technique is provided for torque regulated tension control with active damping.

According to one embodiment of the present invention, a control system for controlling operation of a main drive unit and a secondary drive unit in a web winder system to provide tension control of a continuous material web as it is translated between an unwinder and winder of the web winder system is provided. The control system includes a processor programmed to cause the main drive unit to operate in a velocity mode to set a linear velocity of the continuous material web, receive inputs from tension and speed detectors in the web winder system that detect a tension in and a speed of the continuous material web, and cause the secondary drive unit to operate in a modified torque regulated closed-loop tension control mode so as to control a tension in the web material. In operating in the modified torque regulated closed-loop tension control mode, the processor is further programmed to cause the secondary drive unit to operate according to a torque regulated closed-loop tension control mode, based on inputs from the tension detectors and integrate a speed feedback loop into the torque regulated closed-loop tension control mode, via inputs from the speed detectors, so as to introduce active damping into the tension control.

According to another embodiment of the present invention, web handling system for controlling tension in a web material includes a winder and unwinder between which a web material is transferred and a main drive unit comprising a first electric motor and first adjustable speed drive, the first electric motor and first adjustable speed drive rotationally driving guide rollers to translate the web material from the unwinder to the winder. The web handling system also includes a secondary drive unit comprising a second electric motor and second adjustable speed drive, the second electric motor and second adjustable speed drive rotationally driving the winder to roll the web material onto the winder. The web handling system further includes tension and speed detectors to detect a tension in and a speed of the web material between the unwinder and the winder and a control device to control operation of the main drive unit and the secondary drive unit to rotationally drive the guide rollers and the winder, respectively, at desired rotational speeds, wherein, in controlling operation of the main drive unit and the secondary drive unit to rotationally drive the guide rollers and the winder at desired rotational speeds, the control device is configured to cause the main drive unit to operate in a velocity mode to set a linear velocity of the web material cause the secondary drive unit to operate in a torque regulated closed-loop tension control mode, via inputs from the tension detectors, so as to control a tension in the web material, and integrate a speed feedback loop into the torque regulated closed-loop tension control mode, via inputs from the speed detectors, so as to introduce active damping into the tension control.

According to yet another embodiment of the present invention, a method of controlling tension control in a continuous material web translated between an unwinder and a winder in a web winder system includes controlling a main drive unit of the web winder system to operate in a velocity mode to set a linear velocity of the continuous material web and controlling a secondary drive unit of the web winder system to operate in a modified torque regulated closed-loop tension control mode so as to control a tension in the web material, wherein, in controlling the secondary drive unit, the modified torque regulated closed-loop tension control mode comprises a torque current loop, a tension loop, and a speed feedback loop to control the tension in the web material.

The present invention has been described in terms of the preferred embodiment, and it is recognized that equivalents, alternatives, and modifications, aside from those expressly stated, are possible and within the scope of the appending claims.

What is claimed is:

1. A control system for controlling operation of a main drive unit and a secondary drive unit in a web winder system to provide tension control of a continuous material web as it is translated between an unwinder and winder of the web winder system, the control system having a processor programmed to:

cause the main drive unit to operate in a velocity mode to set a linear velocity of the continuous material web;

receive inputs from tension and speed detectors in the web winder system that detect a tension in and a speed of the continuous material web; and cause the secondary drive unit to operate in a modified torque regulated closed-loop tension control mode so as to control a tension in the web material, wherein operating in the modified torque regulated closed-loop tension control mode comprises:

causing the secondary drive unit to operate according to a torque regulated closed-loop tension control mode, based on inputs from the tension detectors; and integrating a speed feedback loop into the torque regulated closed-loop tension control mode, via inputs from the speed detectors, so as to introduce active damping into the tension control.

2. The control system of claim 1 wherein the processor is programmed to cause the secondary drive unit to operate in a modified torque regulated closed-loop tension control mode according to a closed loop transfer function defined as:

$$G_{\omega_m i_{sq}} = \frac{K_a G_{\omega_m T}}{1 + G_{\omega_m T} R^2 G_{F\Delta v}} = \frac{K_a + K_a F_t s}{J F_t s^2 + J s + R^2 K_F},$$

where F is the actual tension, $\omega_m$ is the actual speed of the winder, $K_a$ is the proportionality coefficient between electromagnetic torque and torque current, $K_F$ is the tension coefficient, $G_{\omega_m T}$ is the transfer function between speed and torque, $G_{F\Delta v}$ is the dynamic transfer function of tension, R is the real-time diameter of the winder, J is the rotational inertia of the winding block, s is a first order speed term.

3. The control system of claim 1 wherein the processor is programmed to cause the secondary drive unit to operate in a modified torque regulated closed-loop tension control mode according to an open loop transfer function defined as:

$$G_F(s) = K_{p_F}\left(1 + \frac{K_{i_F}}{s}\right) = \frac{K_a R K_F}{J F_t s^2 + (K_z K_a F_t + J)s + R^2 K_F + K_z K_a} = K_{p_F}\left(1 + \frac{K_{i_F}}{s}\right)\frac{R K_F K_a}{J F_t \omega_n^2} * \frac{\omega_n^2}{s^2 + 2\xi\omega_n s + \omega_n^2}$$

where F is the actual tension, $K_a$ is the proportionality coefficient between electromagnetic torque and torque current, R is the real-time diameter of the winder, J is the rotational inertia of the winding block, $K_F$ is the tension coefficient, $K_{i_F}$ and $K_z$ are tension PI coefficients, $\omega_n$ is the natural frequency, s is a first order speed term, and $\xi$ is the damping factor.

4. The control system of claim 3 wherein a dominant pole pair in the open loop transfer function has a location defined by:

$$\left\{\sqrt{\omega_P^2 + \frac{K_a K_z}{J F_t}},\ \frac{1}{2\sqrt{\omega_P^2 + \frac{K_a K_z}{J F_t}}}\left(2\xi\omega_p + \frac{K_z K_a}{J}\right)\right\},$$

where F is the actual tension, $K_a$ is the proportionality coefficient between electromagnetic torque and torque current, J is the rotational inertia of the winding block, $K_z$ is a tension PI coefficient, $\omega_n$ is the natural frequency, s is a first order speed term, and $w_p$, $\xi_p$ are the frequency and damping factor for the dominant pole pair.

5. The control system of claim 1 wherein the processor is programmed to increase a crossover frequency of the torque regulated closed-loop tension control mode based on the integration of the speed feedback loop.

6. The control system of claim 1 wherein the processor is programmed to eliminate tension oscillation during a velocity disturbance of the web material, based on the integration of the speed feedback loop into the torque regulated closed-loop tension control mode.

7. The control system of claim 1 wherein the processor is programmed to cause the main drive unit to operate as a master drive unit and the secondary drive unit to operate as a slave drive unit.

8. A web handling system for controlling tension in a web material, the web handling system comprising:

a winder and unwinder between which a web material is transferred;

a main drive unit comprising a first electric motor and first adjustable speed drive, the first electric motor and first adjustable speed drive rotationally driving guide rollers to translate the web material from the unwinder to the winder;

a secondary drive unit comprising a second electric motor and second adjustable speed drive, the second electric motor and second adjustable speed drive rotationally driving the winder to roll the web material onto the winder;

tension and speed detectors to detect a tension in and a speed of the web material between the unwinder and the winder; and a control device to control operation of the main drive unit and the secondary drive unit to rotationally drive the guide rollers and the winder, respectively, at desired rotational speeds;

wherein, in controlling operation of the main drive unit and the secondary drive unit to rotationally drive the guide rollers and the winder at desired rotational speeds, the control device is configured to:

cause the main drive unit to operate in a velocity mode to set a linear velocity of the web material;

cause the secondary drive unit to operate in a torque regulated closed-loop tension control mode, via inputs from the tension detectors, so as to control a tension in the web material; and integrate a speed feedback loop into the torque regulated closed-loop tension control mode, via inputs from the speed detectors, so as to introduce active damping into the tension control.

9. The web handling system of claim 8 wherein the torque regulated closed-loop tension control mode with integrated speed loop is defined as a closed loop transfer function according to:

$$G_{\omega_m i_{sq}} = \frac{K_a G_{\omega_m T}}{1 + G_{\omega_m T} R^2 G_{F\Delta v}} = \frac{K_a + K_a F_t s}{J F_t s^2 + J s + R^2 K_F},$$

where F is the actual tension, $\omega_m$ is the actual speed of the winder, $K_a$ is the proportionality coefficient between electromagnetic torque and torque current, $K_F$ is the tension coefficient, $G_{\omega_m T}$ is the transfer function between speed and torque, $G_{F\Delta v}$ is the dynamic transfer function of tension, R is the real-time diameter of the winder, J is the rotational inertia of the winding block, s is a first order speed term.

10. The web handling system of claim 9 wherein the torque regulated closed-loop tension control mode with integrated speed loop is defined as an open loop transfer function according to:

$$G_F(s) = K_{pF}\left(1 + \frac{K_{iF}}{s}\right) = \frac{K_a R K_F}{J F_t s^2 + (K_z K_a F_t + J)s + R^2 K_F + K_z K_a}$$
$$= K_{p_F}\left(1 + \frac{K_{i_F}}{s}\right)\frac{R K_F K_a}{J F_t \omega_n^2} * \frac{\omega_n^2}{s^2 + 2\xi\omega_n s + \omega_n^2}$$

where F is the actual tension, $K_a$ is the proportionality coefficient between electromagnetic torque and torque current, R is the real-time diameter of the winder, J is the rotational inertia of the winding block, $K_F$ is the tension coefficient, $K_{i_F}$ and $K_z$ are tension PI coefficients, $\omega_n$ is the natural frequency, s is a first order speed term, and $\xi$ is the damping factor.

11. The web handling system of claim 10 wherein a dominant pole pair in the open loop transfer function has a location defined by:

$$\left\{\sqrt{\omega_P^2 + \frac{K_a K_z}{J F_t}},\ \frac{1}{2\sqrt{\omega_P^2 + \frac{K_a K_z}{J F_t}}}\left(2\xi\omega_p + \frac{K_z K_a}{J}\right)\right\},$$

where F is the actual tension, $K_a$ is the proportionality coefficient between electromagnetic torque and torque current, J is the rotational inertia of the winding block, $K_z$ is a tension PI coefficient, $\omega_n$ is the natural frequency, s is a first order speed term, and $w_p$, $\xi_p$ are the frequency and damping factor for the dominant pole pair.

12. The web handling system of claim 8 wherein the control device is configured to increase a crossover frequency of the torque regulated closed-loop tension control mode based on the integration of the speed feedback loop.

13. The web handling system of claim 8 wherein the control device is configured to eliminate tension oscillation during a velocity disturbance of the web material, based on the integration of the speed feedback loop into the torque regulated closed-loop tension control mode.

14. The web handling system of claim 8 wherein the control device comprises a Proportional-Integral (PI) controller.

15. The web handling system of claim 8 further comprising an additional drive unit including a third electric motor and third adjustable speed drive, the third electric motor and third adjustable speed drive rotationally driving the unwinder to unroll the web material.

16. The web handling system of claim 1 wherein the control device is configured to control the main drive unit to operate as a master drive unit and the secondary drive unit to operate as a slave drive unit.

17. A method of controlling tension control in a continuous material web translated between an unwinder and a winder in a web winder system, the method comprising:

controlling a main drive unit of the web winder system to operate in a velocity mode to set a linear velocity of the continuous material web; and controlling a secondary drive unit of the web winder system to operate in a modified torque regulated closed-loop tension control mode so as to control a tension in the web material;

wherein, in controlling the secondary drive unit, the modified torque regulated closed-loop tension control mode comprises a torque current loop, a tension loop, and a speed feedback loop to control the tension in the web material.

18. The method of claim 17 wherein controlling the secondary drive unit of the web winder system to operate in the modified torque regulated closed-loop tension control mode further comprises:

receiving inputs from tension and speed detectors in the web winder system that detect a tension in and a speed of the continuous material web;

causing the secondary drive unit to operate in a torque regulated closed-loop tension control mode comprising the torque current loop and the tension loop, via inputs from the tension detectors, so as to control a tension in the web material; and integrating the speed feedback loop into the torque regulated closed-loop tension control mode, via inputs from the speed detectors, so as to introduce active damping into the tension control.

19. The method of claim 17 wherein the modified torque regulated closed-loop tension control mode is defined as a closed loop transfer function according to:

$$G_{\omega_m i_{sq}} = \frac{K_a G_{\omega_m T}}{1 + G_{\omega_m T} R^2 G_{F\Delta v}} = \frac{K_a + K_a F_t s}{J F_t s^2 + J s + R^2 K_F},$$

where F is the actual tension, $\omega_m$ is the actual speed of the winder, $K_a$ is the proportionality coefficient between electromagnetic torque and torque current, $K_F$ is the tension coefficient, $G_{\omega_m T}$ is the transfer function between speed and torque, $G_{F\Delta v}$ is the dynamic transfer function of tension, R is the real-time diameter of the winder, J is the rotational inertia of the winding block, s is a first order speed term.

20. The method of claim 17 wherein the modified torque regulated closed-loop tension control mode is defined as an open loop transfer function according to:

$$G_F(s) = K_{p_F}\left(1 + \frac{K_{i_F}}{s}\right) = \frac{K_a R K_F}{JF_t s^2 + (K_z K_a F_t + J)s + R^2 K_F + K_z K_a}$$
$$= K_{p_F}\left(1 + \frac{K_{i_F}}{s}\right)\frac{RK_F K_a}{JF_t \omega_n^2} * \frac{\omega_n^2}{s^2 + 2\xi\omega_n s + \omega_n^2}$$

where F is the actual tension, $K_a$ is the proportionality coefficient between electromagnetic torque and torque current, R is the real-time diameter of the winder, J is the rotational inertia of the winding block, $K_F$ is the tension coefficient, $K_{i_F}$ and $K_z$ are tension PI coefficients, $\omega_n$ is the natural frequency, s is a first order speed term, and $\xi$ is the damping factor.

* * * * *